US006949167B2

(12) United States Patent
Shannon et al.

(10) Patent No.: US 6,949,167 B2
(45) Date of Patent: Sep. 27, 2005

(54) TISSUE PRODUCTS HAVING UNIFORMLY DEPOSITED HYDROPHOBIC ADDITIVES AND CONTROLLED WETTABILITY

(75) Inventors: Thomas G. Shannon, Neenah, WI (US); David A. Moline, Appleton, WI (US); John J. Urlaub, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 83 days.

(21) Appl. No.: 10/325,484

(22) Filed: Dec. 19, 2002

(65) Prior Publication Data

US 2004/0118531 A1 Jun. 24, 2004

(51) Int. Cl.[7] ..... D21H 23/30; D21H 23/50; D21H 17/00; D21H 21/16

(52) U.S. Cl. ..... 162/135; 162/109; 162/123; 162/158; 428/195.1; 428/340; 424/402

(58) Field of Search ..... 162/135, 158, 162/179, 109, 111–113, 123–129; 428/195.1, 211, 340; 427/361, 391; 424/402

(56) References Cited

U.S. PATENT DOCUMENTS

| | | | | |
|---|---|---|---|---|
| 3,556,932 | A | | 1/1971 | Coscia et al. |
| 3,556,933 | A | | 1/1971 | Williams et al. |
| 3,700,623 | A | | 10/1972 | Keim |
| 3,772,076 | A | | 11/1973 | Keim |
| 3,855,158 | A | | 12/1974 | Petrovich |
| 3,899,388 | A | | 8/1975 | Petrovich et al. |
| 4,129,528 | A | | 12/1978 | Petrovich et al. |
| 4,147,586 | A | | 4/1979 | Petrovich et al. |
| 4,222,921 | A | | 9/1980 | Van Eenam |
| 4,297,860 | A | | 11/1981 | Pacifici et al. |
| 4,440,597 | A | | 4/1984 | Wells et al. |
| 4,514,345 | A | | 4/1985 | Johnson et al. |
| 4,528,239 | A | | 7/1985 | Trokhan |
| 4,529,480 | A | | 7/1985 | Trokhan |
| 4,773,110 | A | | 9/1988 | Hopkins |
| 4,950,545 | A | | 8/1990 | Walter et al. |
| 5,059,282 | A | | 10/1991 | Ampulski et al. |
| 5,098,522 | A | | 3/1992 | Smurkoski et al. |
| 5,227,242 | A | | 7/1993 | Walter et al. |
| 5,230,776 | A | | 7/1993 | Andersson et al. |
| 5,260,171 | A | | 11/1993 | Smurkoski et al. |
| 5,275,700 | A | | 1/1994 | Trokhan |
| 5,328,565 | A | | 7/1994 | Rasch et al. |
| 5,334,289 | A | | 8/1994 | Trokhan et al. |
| 5,353,521 | A | | 10/1994 | Orloff |
| 5,431,786 | A | | 7/1995 | Rasch et al. |
| 5,496,624 | A | | 3/1996 | Stelljes, Jr. et al. |
| 5,500,277 | A | | 3/1996 | Trakhan et al. |
| 5,514,523 | A | | 5/1996 | Trokhan et al. |
| 5,538,595 | A | | 7/1996 | Trokhan et al. |
| 5,554,467 | A | | 9/1996 | Trokhan et al. |
| 5,558,873 | A | | 9/1996 | Funk et al. |
| 5,566,724 | A | | 10/1996 | Trokhan et al. |
| 5,598,642 | A | | 2/1997 | Orloff et al. |
| 5,624,790 | A | | 4/1997 | Trokhan et al. |
| 5,628,876 | A | | 5/1997 | Ayers et al. |
| 5,637,194 | A | | 6/1997 | Ampulski et al. |
| 5,772,845 | A | | 6/1998 | Farrington, Jr. et al. |
| 5,840,403 | A | | 11/1998 | Trokhan et al. |
| 6,027,611 | A | | 2/2000 | McFarland et al. |
| 6,096,169 | A | | 8/2000 | Hermans et al. |
| 6,103,063 | A | | 8/2000 | Oriaran et al. |
| 6,143,135 | A | | 11/2000 | Hada et al. |
| 6,217,707 | B1 | | 4/2001 | Garvey et al. |
| 6,224,714 | B1 | | 5/2001 | Schroeder et al. |
| 6,231,719 | B1 | | 5/2001 | Garvey et al. |
| 6,238,519 | B1 | | 5/2001 | Jones et al. |
| 6,274,667 | B1 | | 8/2001 | Shannon et al. |
| 6,287,418 | B1 | | 9/2001 | Schroeder et al. |
| 6,365,667 | B1 | | 4/2002 | Shannon et al. |
| 6,432,270 | B1 | | 8/2002 | Liu et al. |
| 6,458,243 | B1 | | 10/2002 | Jones et al. |
| 6,761,800 | B2 | * | 7/2004 | Capizzi ..... 162/184 |
| 2002/0139500 | A1 | | 10/2002 | Runge et al. |
| 2003/0118847 | A1 | * | 6/2003 | Chuang et al. ..... 428/447 |
| 2003/0118848 | A1 | * | 6/2003 | Liu ..... 428/447 |
| 2004/0079502 | A1 | * | 4/2004 | Capizzi ..... 162/135 |
| 2004/0084162 | A1 | * | 5/2004 | Shannon et al. ..... 162/109 |
| 2004/0084165 | A1 | * | 5/2004 | Shannon et al. ..... 162/158 |
| 2004/0118531 | A1 | * | 6/2004 | Shannon et al. ..... 162/109 |
| 2004/0118532 | A1 | * | 6/2004 | Sarbo et al. ..... 162/109 |
| 2004/0131842 | A1 | * | 7/2004 | Urlaub et al. ..... 428/327 |
| 2004/0144507 | A1 | * | 7/2004 | Shannon et al. ..... 162/9 |
| 2004/0163784 | A1 | * | 8/2004 | Urlaub et al. ..... 162/135 |
| 2004/0163785 | A1 | * | 8/2004 | Shannon et al. ..... 162/158 |

FOREIGN PATENT DOCUMENTS

| | | |
|---|---|---|
| WO | WO 0149933 A3 | 7/2001 |
| WO | WO 0149933 A2 | 7/2001 |
| WO | WO 0149937 A1 | 7/2001 |

* cited by examiner

*Primary Examiner*—José A. Fortuna
*Assistant Examiner*—Dionne W. Mayes
(74) *Attorney, Agent, or Firm*—Dority & Manning, P.A.

(57) ABSTRACT

Tissue products are disclosed that contain a hydrophobic additive, such as a polysiloxane. In accordance with the present invention, the tissue products are further treated with a wetting agent. The wetting agent may be applied after application of the hydrophobic additive to one or more surfaces of the base sheet. The wetting agent improves the wettability properties of the base sheet.

55 Claims, 3 Drawing Sheets

TISSUE PRODUCTS HAVING UNIFORMLY DEPOSITED HYDROPHOBIC ADDITIVES AND CONTROLLED WETTABILITY

BACKGROUND OF THE INVENTION

Consumers use paper products, such as facial tissues, bath tissues, and paper towels, for a wide variety of applications. Facial tissues are not only used for nose care but, in addition to other uses, can also be used as a general wiping product. Consequently, there are many different types of tissue products currently commercially available.

In some applications, paper products are treated with lotions and/or various other additives for numerous desired benefits. For example, formulations containing polysiloxanes have been topically applied to tissue products in order to increase the softness of the product. In particular, adding silicone compositions to a facial tissue can impart improved softness to the tissue while maintaining the tissue's strength. For example, polysiloxane treated tissues are described in U.S. Pat. Nos. 4,950,545; 5,227,242; 5,558,873; 6,054,020; 6,231,719 and 6,432,270 and which are incorporated by reference herein. A variety of substituted and non-substituted polysiloxanes can be used.

While polysiloxanes are exceptionally good at improving softness there are drawbacks to their use. Polysiloxanes are generally hydrophobic, that is, they tend to repel water. Tissue products treated with polysiloxane tend to be less absorbent than tissue products not containing polysiloxane. Hydrophilic polysiloxanes are known in the art, however, such hydrophilic polysiloxanes are more water soluble and hence when applied to a tissue sheet will tend to migrate more in the z-direction of the sheet than the hydrophobic polysiloxanes. This means that less polysiloxane is available on the surface of the tissue product at a given addition level. Hence, higher levels of hydrophilic polysiloxanes are required to achieve the same level of softness as hydrophobic polysiloxanes. Hydrophilic polysiloxanes are also usually sold at a cost premium to the hydrophobic polysiloxanes. Therefore, hydrophilic polysiloxanes tend to be less effective at softening and more costly to use than hydrophobic polysiloxanes.

Polysiloxanes effective in providing surface softness to the sheet also tend to be poorly retained in the wet end of the tissue making process. Hence, to get the most benefit topical application to a formed tissue sheet is usually required. This topical application requires significant capital expense or machine modifications to employ in existing processes not set to employ topical application of polysiloxanes.

In co-pending U.S. application Ser. No. 09/802,529 filed Apr. 3, 2001 by Runge, et. al., a method for preparing fibers containing hydrophobic entities, including hydrophobic polysiloxanes, at a pulp mill is disclosed. These so called "polysiloxane pretreated fibers" can then be re-dispersed in the wet end of a paper-making process to manufacture paper products containing polysiloxane. It has been found that fibers treated with polysiloxane and dried prior to being re-dispersed and formed into a tissue sheet demonstrate excellent retention of the polysiloxane through the tissue making process. Unfortunately, use of these pretreated fibers in tissue products can lead to unacceptably high levels of hydrophobicity even when low levels of polysiloxane are used. In certain cases, the degree of hydrophobicity introduced into the sheet using polysiloxane pretreated fibers is greater than when the same level of polysiloxane is topically applied to the sheet by the methods known in the art.

Increased hydrophobicity in a paper product, such as a tissue, can adversely impact upon the ability of the wiping product to absorb liquids. Hydrophobic agents can also prevent bath tissue from being wetted in a sufficient amount of time and prevent disintegration and dispersing when disposed in a commode or toilet.

On the other hand, increasing the hydrophobicity of a paper web does provide various advantages. For example, by making the web hydrophobic, the fluid strike-through properties of the tissue product are improved. In other words, fluids absorbed by the web remain on the interior of the web and thus do not transfer to the hands of a user. Hydrophobic tissue products prepared using standard cellulose sizing agents are described in U.S. Pat. No. 6,027,611 issued to McFarland, et.al., and incorporated by reference herein. However, those skilled in the art will recognize the difficulties associated with using sizing agents to control hydrophobicity to a level acceptable for tissue products, the addition often resulting in products having unacceptably high levels of hydrophobicity. Furthermore, addition of sizing agents as described by McFarland, et.al., does not allow for regions of high and low hydrophobicity in the sheet but rather creates a uniformly hydrophobic sheet. Hence, additives that are hydrophobic in nature can make it difficult to find a proper balance between improving the properties of a web through the use of the additive and yet maintaining acceptable absorbency and wetability characteristics.

It is known to add a wetting agent directly to a polysiloxane emulsion then topically apply the polysiloxane, wetting agent composition to the tissue sheet to mitigate the hydrophobicity caused by addition of the polysiloxane. While this perhaps reduces the overall hydrophobicity of the sheet it does not allow for making tissues having uniform polysiloxane coverage with alternating hydrophobic and hydrophilic regions. Furthermore, combination of wetting agents with polysiloxane precludes application of the polysiloxane prior to the tissue making process. As the wetting agents are water soluble or water dispersible they are prone to loss during the tissue making process and, hence, the finished tissue sheet maintains its hydrophobicity.

It is also known to topically apply hydrophobic additives in discrete locations on a tissue sheet in conjunction with relatively large untreated areas of the sheet such that less than 50% of the surface of the sheet is covered with the additive. Such discrete placement of the additive on the tissue sheet is expected to provide regions of hydrophobicity and hydrophilicity. However, such discrete placement requires a majority of the tissue surface to not contain the additive. As a result, reduced product benefits, such as softness, are realized relative to a sheet having a high level of surface coverage. Furthermore, this process precludes use of hydrophobic additives prior to the tissue sheet forming step. Hence, processes that employ applying the hydrophobic additive in discrete locations on the tissue sheet surface, preclude addition of the hydrophobic additive to the fiber slurry in the wet-end of the tissue process or addition of the hydrophobic additive as pretreated fibers. Addition of the hydrophobic additive prior to the tissue forming process, either in the wet end fiber slurry or as pretreated fibers, is preferred since minimum added capital cost is needed for employment on existing tissue assets.

U.S. Pat. Nos. 6,238,519 and 6,458,243 issued to Jones, et.al, describe the use of deactivated ketene dimer agents to reduce the hydrophobicity of sheets relative to those made with standard alkyl ketene dimers. While lower hydrophobicity is noted, the application precludes formation of specific regions of hydrophobicity and hydrophilicity, hence, the application of deactivated ketene dimers does not allow for fine tuning control of hydrophobic and hydrophilic properties.

Thus, a need currently exists for tissue products and methods to prepare tissue products containing hydrophobic additives wherein the hydrophobic additive is present across a majority of the sheet surface, yet the benefits to the product are provided without increasing the hydrophobicity of the product beyond desirable limits. Furthermore there is a need to produce such products in a manner that the hydrophobic additive may be applied prior to the sheet forming step in the wet end of the tissue process or as pretreated pulp fibers. There is furthermore a need for tissue products and processes for preparing tissue products that have a majority of their surface containing a hydrophobic additive, yet have selective regions of hydrophobicity and hydrophilicity.

SUMMARY OF THE INVENTION

In general, the present invention is directed to maintaining acceptable wettability characteristics in paper products that have been treated with an additive that intentionally or unintentionally makes the paper product hydrophobic. Said additives being incorporated into the product for purposes of improving the properties of the product. In particular, the wettability properties of the paper product are maintained even in the presence of the additive by treating the paper product with a wetting agent in accordance with the present invention.

For example, one embodiment of the present invention is directed to a tissue product that comprises a base sheet containing pulp fibers. The base sheet can be a single ply sheet or a multi-ply sheet and can have a bulk density of at least about 2 cc/g. The basis weight of the base sheet can be from about 6 gsm to about 150 gsm. The base sheet contains a hydrophobic additive, hereinafter defined as an additive that used alone or in combination with another chemical makes the tissue product hydrophobic. The hydrophobic additive may or may not be in itself hydrophobic. The hydrophobic additive can be applied topically to the base sheet or can be incorporated into the base sheet by, for instance, pre-treating the pulp fibers with the hydrophobic additive prior to formation of the sheet or can also be added to the fibers in a slurry with water. In one embodiment, the additive that makes the sheet hydrophobic is distributed uniformly (meaning in the x-y plane of the sheet) and applied in an amount that makes the sheet hydrophobic without the presence of the wetting agent. A hydrophobic sheet is defined as one having a wet out time, hereinafter defined, of greater than about 120 seconds, more specifically greater than about 180 seconds and most specifically greater than about 240 seconds.

The hydrophobic additive is applied uniformly over the x-y direction of the tissue sheet in a manner that at least about 20%, more specifically at least about 50% and still more specifically at least about 65% of the x-y plane of the sheet contains the said additive. In a specific embodiment the hydrophobic additive is applied in the wet end of the process prior to the sheet forming process either by addition to a slurry of pulp in water or by addition as pretreated fibers as hereinafter defined. This specific embodiment is meant to imply that the hydrophobic additive is thus present uniformly in the sheet and that 100% of the x-y plane of the sheet contains the said additive. The amount of coverage of the hydrophobic additive in the z-direction of the sheet may or may not be uniform and in a specific embodiment it is not uniform with a higher concentration of the hydrophobic additive near one or both surfaces of the tissue sheet or product.

The hydrophobic additive can be any suitable additive that may be applied to the base sheet in order to improve its properties. For example, in one embodiment, the hydrophobic additive can be a softening composition. The softening composition can contain, for instance, a polysiloxane.

In accordance with the present invention, the base sheet further includes a wetting agent applied to at least one side of the sheet. The wetting agent may be applied to the sheet so as to create treated areas and untreated areas. By treating the base sheet with a wetting agent, the base sheet is capable of quickly absorbing liquids that come into contact with the base sheet even in the presence of the hydrophobic additive.

Various wetting agents can be used in accordance with the present invention. In general, the wetting agent has an HLB of from about 7 to about 25. The HLB index is well known in the chemical arts and is a scale which measures the balance between the hydrophilic and lipophilic solution tendencies of a compound. The HLB scale ranges from 1 to approximately 50, with the lower numbers representing highly lipophilic tendencies and the higher numbers representing highly hydrophilic tendencies. Wetting agents having HLB numbers greater than about 7 are usually defined as being "water-soluble". Examples of wetting agents that can be used in accordance with the present invention include polyhydroxy compounds, non-ionic surfactants, linear alkoxylated alcohols, linear alkylphenoxylated alcohols, olefinic alkoxylates, branched chain alkoxylates, and the like. Further examples of wetting agents include acetylenic diols, silicone polyethers, silanes, silicone copolyols, and the like. In one embodiment the surfactants are water soluble at an amount of 0.5% by weight or higher or water dispersible but this is not a requirement of the invention.

The wetting agent can be printed onto the base sheet or sprayed onto the base sheet. When printed onto the base sheet, the wetting agent can be applied using, for instance, a rotogravure printer, a flexographic printer, or an inkjet printer.

The wetting agent can be applied to the base sheet so as to cover less than about 50 percent of the surface area of one side of the sheet. The wetting agent can be applied so that the tissue product has a wet out time of less than about 120 seconds, particularly less than about 60 seconds, and more particularly less than about 20 seconds.

Other features and advantages of the present invention will be made apparent from the following detailed description.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
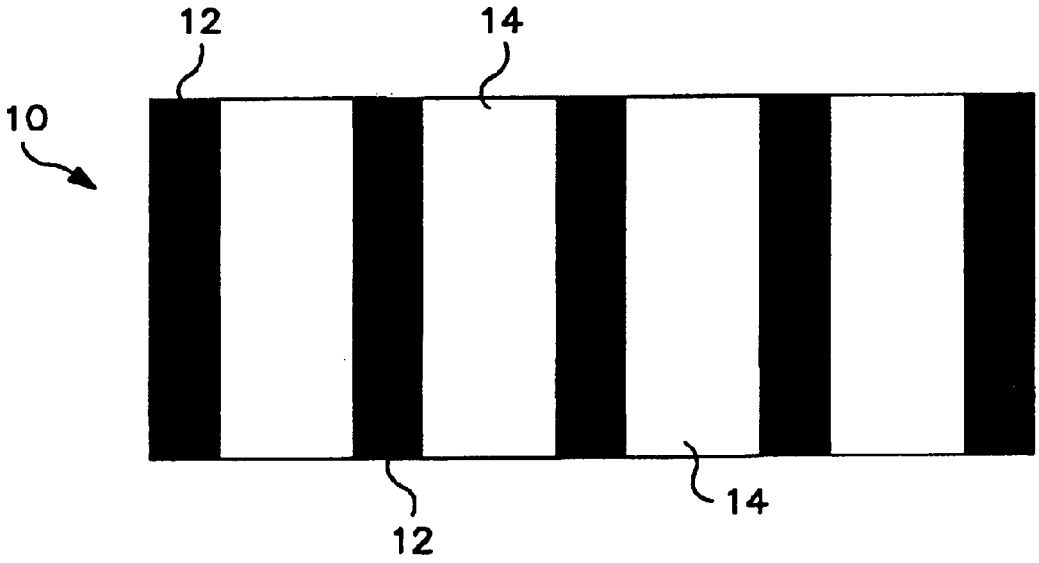
FIG. 1 is a plan view of one embodiment of a tissue product made in accordance with the present invention illustrating application of a wetting agent.

Repeat use of reference characters in the present specification and drawings is intended to represent same or analogous features or elements of the present invention.

DETAILED DESCRIPTION

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

The present invention is generally directed to paper products that have been treated with a hydrophobic additive. For example, in one embodiment, the hydrophobic additive can comprise a softening composition containing a polysiloxane. The polysiloxane can be applied to the tissue product topically, such as through printing. Alternatively, cellulose fibers can be pretreated with the polysiloxane and then later formed into the tissue product. Although the polysiloxane composition improves the softness and other properties of the web, in some cases, application of the polysiloxane additive will make a tissue product hydrophobic with poor absorbency characteristics. Thus, in the past, the type of silicone or silicone emulsion that was applied to the tissue product was carefully chosen in order to balance hydrophobicity with the improvement in properties that was realized in using the additive. For example, in some applications, the polysiloxane was chemically modified to make the polysiloxane less hydrophobic. Chemically modifying the polysiloxane, however, may result in a decrease in the ability of the additive to improve the properties of the tissue and can increase the cost of the process. Additionally, hydrophilic polysiloxanes may tend to be retained poorly in the wet end of a tissue machine process and may preclude their use in pretreated fiber applications.

In order to counteract the adverse impact a hydrophobic additive may have on a tissue product, the present invention is directed to the application of a wetting agent in conjunction with a hydrophobic additive. The wetting agent achieves a hydrophilic sheet that allows the tissue product to intake fluids rapidly. By applying the wetting agent to a tissue product pretreated with a hydrophobic additive, the present inventors have discovered that the amount of time needed for the product to absorb liquids decreases significantly.

The use of a wetting agent in accordance with the present invention also provides various other benefits and advantages. For example, in addition to improving the absorbency characteristics of the tissue product, use of the wetting agent alleviates the need to chemically modify known hydrophobic additives, such as polysiloxanes. Further, the wetting agent can be applied to the tissue product using any suitable method according to any desired pattern for not only improving absorbency characteristics, but for also controlling the absorbency characteristics as well.

While the current invention is applicable to any paper sheet, the process of the present invention is particularly well suited for use in conjunction with paper tissue and towel products. Paper tissue and towel products as used herein are differentiated from other paper products in terms of their bulk. The bulk of the products of this invention is calculated as the quotient of the caliper (hereinafter defined), express in microns, divided by the basis weight, expressed in grams per square meter. The resulting bulk is expressed as cubic centimeters per gram. Writing papers, newsprint and other such papers have higher strength, stiffness, and density (low bulk) in comparison to tissue products which tend to have much higher calipers for a given basis weight. The tissue products of the present invention have a bulk greater than 2 g/cm$^3$, more preferably greater than 2.5 g/cm$^3$ and still more preferably greater than about 3 g/cm$^3$.

The caliper as used herein is the thickness of a single sheet and can either be measured as the thickness of a single sheet or as the thickness of a stock of ten sheets and dividing the ten sheet thickness by ten, where each sheet within the stack is placed with the same side up. Caliper is expressed in microns. It is measured in accordance with TAPPI test methods T402 'Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 kilo Pascals).

Tissue products particularly well suited for use in the present invention include paper towels, industrial wipers, bath tissue, facial tissue, and the like. The tissue product can be a single ply product or, alternatively, a multi-ply product. For example, in one embodiment, the tissue product is a three-ply facial tissue.

As described above, the present invention is generally directed to the use of a wetting agent to improve the absorbency properties of a tissue product that has been treated with a hydrophobic additive. The additive may be applied intentionally to increase the hydrophobicity of the sheet. Alternatively the additive may be applied to the sheet to enhance some other product attribute of the sheet with the hydrophobicity of the sheet arising as an unintended side effect. The hydrophobic additive can be an additive that is applied to the tissue product in order to improve various properties of the product. For example, the hydrophobic additive may be applied to improve the softness of the tissue sheet, or to improve the resistance of the tissue product to strike through of liquids. Strike through refers to the ability of liquids to penetrate through the width of the tissue in the z-direction. In general, it is believed that the wetting agent of the present invention can be used with any possible hydrophobic additive that may be applied to the tissue product.

In one embodiment of the present invention, the hydrophobic additive may be selected from agents known for imparting hydrophobicity to sheets including internal sizing agents such as acid rosin, alkenyl ketene dimers, alkenyl succinic anhydride, alkyl ketone dimers, and alkenol ketene dimers. Other suitable sizing agents are described in "Papermaking and Paper Board Making", 2$^{nd}$ ed., Volume III, edited by R. G. MacDonald and J. N. Franklin, incorporated herein by reference.

In another particular embodiment of the present invention, the hydrophobic additive is a softener. The softener can contain, for instance, a polysiloxane that makes a tissue product feel softer to the skin of a user.

Polysiloxanes encompass a very broad class of compounds. They are characterized in having a backbone structure:

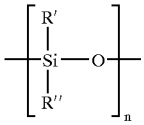

where R' and R" can be a broad range of organo and non-organo groups including mixtures of such groups and where n is an integer greater than 2. These polysiloxanes may be linear, branched or cyclic. They include a wide variety of polysiloxane copolymers containing various compositions of functional groups, hence, R' and R" actually may represent many different types of groups within the same polymer molecule. The organo or non-organo groups may be capable of reacting with cellulose to covalently, ionically or hydrogen bond the polysiloxane to the cellulose. These functional groups may also be capable of reacting with themselves to form crosslinked matrixes with the cellulose. The scope of the invention should not be construed as limited by a particular polysiloxane structure so long as that polysiloxane structure delivers the aforementioned product or process benefits.

While not wishing to be bound by theory, the softness benefits that polysiloxanes deliver to cellulose containing products is believed to be, in part, related to the molecular weight of the polysiloxane. Viscosity is often used as an indication of molecular weight of the polysiloxane as exact number or weight average molecular weights are often difficult to determine. The viscosity of the polysiloxanes of the present invention is greater than about 25 centipoise, more preferably greater than 50 centipoise and most preferably greater than 100 centipoise. Viscosity as referred to herein refers to the viscosity of the neat polysiloxane itself and not to the viscosity of an emulsion if so delivered. It should also be understood that the polysiloxanes of the current invention may be delivered as solutions containing diluents. Such diluents may lower the viscosity of the solution below the limitations set above, however, the efficacious part of the polysiloxane should conform to the viscosity ranges given above. Examples of such diluents include but is not limited to oligomeric and cyclo-oligomeric polysiloxanes such as octamethylcyclotetrasiloxane, octamethyltrisiloxane, decamethylcyclopentasiloxane, decamethyltetrasiloxane and the like including mixtures of said compounds.

A specific class of polysiloxanes suitable for the invention has the general formula:

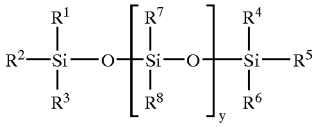

Wherein the $R^1$–$R^8$ moieties can be independently any organofunctional group including $C_1$ or higher alkyl groups, ethers, polyethers, polyesters, amines, imines, amides, or other functional groups including the alkyl and alkenyl analogues of such groups and y is an integer >1. Preferably the $R^1$–$R^8$ moieties are independently any $C_1$ or higher alkyl group including mixtures of said alkyl groups. Exemplary fluids are the DC-200 fluid series, manufactured and sold by Dow Corning, Inc.

In one embodiment, the polysiloxane is chosen from the group of so called "amino functional" functional polysiloxanes of the general formula:

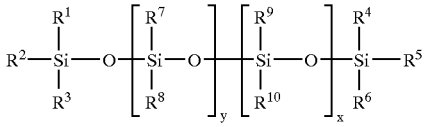

Wherein, x and y are integers >0. The mole ratio of x to (x+y) can be from about 0.005 percent to about 25 percent. The $R^1$–$R^9$ moieties can be independently any organofunctional group including $C_1$ or higher alkyl groups, ethers, polyethers, polyesters, amines, imines, amides, or other functional groups including the alkyl and alkenyl analogues of such groups. The $R^{10}$ moiety is an amino functional moiety including but not limited to primary amine, secondary amine, tertiary amines, quaternary amines, unsubstituted amides and mixtures thereof. An exemplary $R^{10}$ moiety contains one amine group per constituent or two or more amine groups per substituent, separated by a linear or branched alkyl chain of $C^1$ or greater. An exemplary material includes but is not limited to 2-8220 fluid manufactured and sold by Dow Corning.

It should also be recognized that often it is advantageous to use a blend of various functional polysiloxanes.

The hydrophobic additive can be applied to the tissue product according to various methods with the exact method not being overly critical to the invention. In one embodiment of the present invention the hydrophobic additive is applied to the sheet after the sheet is formed. The topical application of the hydrophobic additive to the tissue sheet can be done via any method known in the art including but not limited to:

- A spray applied to fibrous tissue sheet. For example, spray nozzles may be mounted over a moving wet tissue sheet to apply a desired dose of hydrophobic additive to the wet tissue sheet. Nebulizers may also be used to apply a light mist to a surface of a wet tissue sheet.
- Non-contact printing methods such as ink jet printing, digital printing of any kind, and the like.
- Coating onto one or both surfaces of the wet tissue sheet, such as blade coating, air knife coating, short dwell coating, cast coating, and the like.
- Extrusion from a die head such as UFD spray tips, such as available from ITW-Dynatec of Henderson, Tenn., of the hydrophobic additive in the form of a solution, a dispersion or emulsion, or a viscous mixture.
- Impregnation of the wet tissue sheet with a solution or slurry, wherein the hydrophobic additive penetrates a significant distance into the thickness of the wet tissue sheet, such as more than 20% of the thickness of the wet tissue sheet, more specifically at least about 30% and most specifically at least about 70% of the thickness of the wet tissue sheet, including completely penetrating the wet tissue sheet throughout the full extent of its thickness. One useful method for impregnation of a wet tissue sheet is the Hydra-Sizer® system, produced by Black Clawson Corp., Watertown, N.Y., as described in "New Technology to Apply Starch and Other Additives," Pulp and Paper Canada, 100(2): T42–T44 (February 1999). This system consists of a die, an adjustable support structure, a catch pan, and an additive supply system. A thin curtain of descending liquid or slurry is created which contacts the moving tissue sheet beneath it. Wide ranges of applied doses of the coating material are said to be achievable with good runnability. The system may also be applied to curtain coat a relatively dry tissue sheet, such as a tissue sheet just before or after creping.

Foam application of the polysiloxane composition to the wet fibrous tissue sheet (e.g., foam finishing), either for topical application or for impregnation of the compound into the tissue sheet under the influence of a pressure differential (e.g., vacuum-assisted impregnation of the foam). Principles of foam application of additives such as binder agents are described in U.S. Pat. No. 4,297,860, issued on Nov. 3, 1981 to Pacifici et al. and U.S. Pat. No. 4,773,110, issued on Sep. 27, 1988 to G. J. Hopkins, the disclosures of both which are herein incorporated by reference to the extent that they are non-contradictory herewith.

Application of the polysiloxane composition by spray or other means to a moving belt or fabric which in turn contacts the tissue sheet to apply the chemical to the tissue sheet, such as is disclosed in WO 01/49937 under the name of S. Eichhorn, published on Jun. 12, 2001.

When topically applied, the hydrophobic additive can be applied to the sheet so as to cover substantially all of the sheet or can be applied in a pattern. For example, the hydrophobic additive can be applied to cover any where from about 20 percent to 100 percent of the surface area of the base sheet. The hydrophobic additive can be applied to a single side or can be applied to both sides of the base sheet. Further, when the tissue product is a multi-ply product, the hydrophobic additive can be applied to the outer plies and/or the inner plies.

In an alternative embodiment, the hydrophobic additive can be applied to the fibers that are used to form the base sheet. For example, in one embodiment, a fibrous web can be treated with a hydrophobic additive prior to the finishing operation at a pulp mill. For example, in co-pending U.S. application Ser. No. 09/802,529 filed Apr. 3, 2001 by Runge, et. al., a method for preparing fibers containing hydrophobic entities, including hydrophobic polysiloxanes, at a pulp mill is disclosed. Once the hydrophobic additive is applied to the fibrous web, the finishing operation can be completed and the finished pulp can be redispersed for use in the production of a paper product. Good retention of the hydrophobic additive through the tissue making process is achieved when the hydrophobic additives are applied via the process of Runge.

For example, in this embodiment, the method of applying the hydrophobic additive can include combining process water and virgin pulp fibers. The fiber slurry may be transported to a web-forming apparatus of a pulp sheet machine and formed into a wet fibrous web. The wet fibrous web is dried to a predetermined consistency thereby forming a dried fibrous web. The dried fibrous web may then be treated with the hydrophobic additive thereby forming a chemically treated dried fibrous web containing chemically treated pulp fibers. The treated web is then redispersed in water and the pulp fibers are used to form a paper product in accordance with the present invention.

In one embodiment, the fibers are pretreated with a polydimethylsiloxane, such as a modified polydimethylsiloxane as described above. For example, modified polydimethylsiloxanes can include amino-functional polydimethylsiloxanes, alkylene oxide-modified polydimethylsiloxanes, organomodified polysiloxanes, mixtures of cyclic and non-cyclic modified polydimethysiloxanes and the like.

Although dependent upon the particular application and the hydrophobic additive utilized, the amount of additive that can be retained by the chemically pretreated pulp fibers is about 0.1 kilogram per metric ton or greater. For example, the amount of retained hydrophobic additive can be greater than about 0.5 kilograms per metric ton, particularly greater than about 1 kilogram per metric ton and more particularly greater than about 2 kilograms per metric ton.

As explained above, hydrophobic additives, such as polysiloxanes, were in the past use sparingly in some applications due to their hydrophobicity. By subsequently treating the base sheet of the tissue product with a wetting agent, however, it has been discovered by the present inventors that any adverse impact on the base sheet due to the presence of the hydrophobic additive can be counteracted.

In still another embodiment, the hydrophobic additive may be added prior to formation of the tissue web sheet when the fibers are suspended in water. This may include, for example, addition to the pulper, a machine chest, the headbox or to the tissue web sheet prior to being formed and dried where the consistency is about 50% or less. In a specific embodiment the hydrophobic chemical additive is directly added to a fibrous slurry, such as by injection of the hydrophobic additive into a fibrous slurry prior to entry in the headbox. Slurry consistency can be from about 0.2% to about 50%, specifically from about 0.2% to about 10%, more specifically from about 0.3% to about 5%, and most specifically from about 1% to about 4%.

For the tissue sheets of the present invention, both creped and uncreped methods of manufacture may be used. Uncreped tissue production is disclosed in U.S. Pat. No. 5,772,845, issued on Jun. 30, 1998 to Farrington, Jr. et al., the disclosure of which is herein incorporated by reference to the extent it is non-contradictory herewith. Creped tissue production is disclosed in U.S. Pat. No. 5,637,194, issued on Jun. 10, 1997 to Ampulski et al.; U.S. Pat. No. 4,529,480, issued on Jul. 16, 1985 to Trokhan; U.S. Pat. No. 6,103,063, issued on Aug. 15, 2000 to Oriaran et al.; and, U.S. Pat. No. 4,440,597, issued on Apr. 3, 1984 to Wells et al., the disclosures of all of which are herein incorporated by reference to the extent that they are non-contradictory herewith. Also suitable for application of the above mentioned hydrophobic additives are tissue sheets that are pattern densified or imprinted, such as the webs disclosed in any of the following U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Steltjes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996 to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; and, U.S. Pat. No. 5,628,876, issued on May 13, 1997 to Ayers et al., the disclosures of all of which are herein incorporated by reference to the extent that they are non-contradictory herewith. Such imprinted tissue sheets may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet superposed over the deflection conduits is deflected by an air pressure differential across the deflection conduit to form a lower-density pillow-like region or dome in the tissue sheet.

Various drying operations may be useful in the manufacture of the tissue products of the present invention. Examples of such drying methods include, but are not limited to, drum drying, through drying, steam drying such as superheated steam drying, displacement dewatering, Yankee drying, infrared drying, microwave drying, radiofrequency drying in general, and impulse drying, as disclosed in U.S. Pat. No. 5,353,521, issued on Oct. 11, 1994 to Orloff and U.S. Pat. No. 5,598,642, issued on Feb. 4, 1997 to Orloff et al., the disclosures of both which are herein incorporated by reference to the extent that they are non-contradictory herewith. Other drying technologies may be used, such as methods employing differential gas pressure include the use of air presses as disclosed U.S. Pat. No. 6,096,169, issued on Aug. 1, 2000 to Hermans et al. and U.S. Pat. No. 6,143,135, issued on Nov. 7, 2000 to Hada et al., the disclosures of both which are herein incorporated by reference to the extent they are non-contradictory herewith. Also relevant are the paper machines disclosed in U.S. Pat. No. 5,230,776, issued on Jul. 27, 1993 to I. A. Andersson et al.

The tissue product may contain a variety of fiber types both natural and synthetic. In one embodiment the tissue product comprises hardwood and softwood fibers. The overall ratio of hardwood pulp fibers to softwood pulp fibers within the tissue product, including individual tissue sheets making up the product may vary broadly. The ratio of hardwood pulp fibers to softwood pulp fibers may range from about 9:1 to about 1:9, more specifically from about 9:1 to about 1:4, and most specifically from about 9:1 to about 1:1. In one embodiment of the present invention, the hardwood pulp fibers and softwood pulp fibers may be blended prior to forming the tissue sheet thereby producing a homogenous distribution of hardwood pulp fibers and softwood pulp fibers in the z-direction of the tissue sheet. In another embodiment of the present invention, the hardwood pulp fibers and softwood pulp fibers may be layered so as to give a heterogeneous distribution of hardwood pulp fibers and softwood pulp fibers in the z-direction of the tissue sheet. In another embodiment, the hardwood pulp fibers may be located in at least one of the outer layers of the tissue product and/or tissue sheets wherein at least one of the inner layers may comprise softwood pulp fibers. In still another embodiment the tissue product contains secondary or recycled fibers optionally containing virgin or synthetic fibers.

In addition, synthetic fibers may also be utilized in the present invention. The discussion herein regarding pulp fibers is understood to include synthetic fibers. Some suitable polymers that may be used to form the synthetic fibers include, but are not limited to: polyolefins, such as, polyethylene, polypropylene, polybutylene, and the like; polyesters, such as polyethylene terephthalate, poly(glycolic acid) (PGA), poly(lactic acid) (PLA), poly(β-malic acid) (PMLA), poly(ε-caprolactone) (PCL), poly(ρ-dioxanone) (PDS), poly(3-hydroxybutyrate) (PHB), and the like; and, polyamides, such as nylon and the like. Synthetic or natural cellulosic polymers, including but not limited to: cellulosic esters; cellulosic ethers; cellulosic nitrates; cellulosic acetates; cellulosic acetate butyrates; ethyl cellulose; regenerated celluloses, such as viscose, rayon, and the like; cotton; flax; hemp; and mixtures thereof may be used in the present invention. The synthetic fibers may be located in one or all of the layers and sheets comprising the tissue product.

In general, any suitable wetting agent can be used according to the present invention. The wetting agent can be, for instance, a polyhydroxy compound, a non-ionic surfactant, a linear alkoxlated alcohol, a linear alkylphenoxylated alcohol, an olefinic alkoxylate, a branched chain alkoxylate, and the like. In other embodiments, the wetting agent can also be a silicone polyether, a silane, or a silicone copolyol. For most applications, the wetting agent should have an HLB of from about 7 to about 20. Further, in many applications, a wetting agent having greater polarity may produce better results.

An example of polyhydroxy compounds useful in the present invention include glycerol, polyglycerols having a molecular weight of from about 150 to about 800, and polyethylene glycols and polyoxypropylene glycols having a molecular weight of from about 200 to about 4,000. The above-described polyhydroxy compounds can also be mixed together and used.

In one particular embodiment, the polyhydroxy compound is polyethylene glycol having a molecular weight of about 400. Such material is commercially available from the Union Carbide Company under the trade name PEG-400.

Suitable non-ionic surfactants that can be used in the present invention include addition products of alkylene oxides, such as ethylene oxide, and propylene oxide, with fatty alcohols, fatty acids, fatty amines, and the like.

For example, suitable alkoxylated material include compounds having the following formula:

$$R—X—(C_2H_4O)_z—C_2H_4OH$$

wherein R is selected from the group consisting of primary, secondary, and branched chain alkyl and/or acyl hydrocarbyl groups; primary, secondary, and branched chain alkenyl hydrocarbyl groups; and primary, secondary, and branched chain alkyl- and alkenyl-substituted phenolic hydrocarbyl groups; the hydrocarbyl groups having a hydrocarbyl chain length of from about 8 to about 20 carbon atoms. Y in the above formula is typically —O—, —C(O)O—, —C(O)N(R)—, or —C(O)N(R)R— in which R can be as describe above or can be hydrogen. In the above formula z is at least about 8, such as at least about 10. In general, longer alkoxylate groups perform better.

Linear alkoxylated alcohols that may be used include the deca-, undeca-, dodeca-, tetradaca-, and pentadeca-ethoxylates of n-hexadecanol, and n-octadecanol. Exemplary ethoxylated primary alcohols useful are n-$C_{18}$EO(10); and n-$C_{10}$EO(11). The ethoxylates of mixed natural or synthetic alcohols in the "oleyl" chain length range are also useful. Such materials include oleylalcohol-EO(11), oleylalcohol-EO(18), and oleylalcohol-EO(25).

Other linear alkoxylated alcohols include the deca-, undeca-, dodeca-, tetradeca-, pentadeca-, octadeca-, and nonadeca-ethoxylates of 3-hexadecanol, 2-octadecanol, 4-eicosanol, and 5-eicosanol. Exemplary alkoxylated secondary alcohols that can be used in the present invention include 2-$C_{16}$EO(11); 2-$C_{20}$EO(11); and 2-$C_{16}$EO(14).

Linear alkyl phenoxylated alcohols that may be used in the present invention include the hexa-through octadeca-ethoxylates of alkylated phenols, particularly monohydric alkylphenols. Other examples of linear alkylphenoxylated alcohols include the hexa-through octadeca-ethoxylates of p-tridecylphenol, m-pentadecylphenol, and the like. Exemplary ethoxylated alkylphenols useful as wetting agents are p-tridecylphenol EO(11) and p-pentadecylphenol EO(18).

Olefinic alkoxylates that may be used in the present invention as wetting agents include alkenyl alcohols, both primary and secondary, and alkenyl phenols corresponding to those disclosed above that can be ethoxylated to have an HLB value within the above-described range.

Branched chain alkoxylates include the primary and secondary alcohols which are available from the "OXO" process that can be ethoxylated.

In addition to the above wetting agents, various silicones and silanes may also be used. For example, silicone polyethers, silicone copolyols and ethoxylated polysiloxanes such as Methyl (propylhydroxide, ethoxylated) bis (trimethylsiloxy) silane may be used in the present invention. These materials are generally low viscosity silicon containing materials that are water soluble or water dispersible without surfactants. They may also employ additional surfactants such as polyethylene glycol, polypropylene glycol and derivatives thereof. An example of a commercially available silane polyether is product number Q2-5211 marketed by Dow Corning Corporation. Q2-5211 has an HLB value of approximately 12, a viscosity at 25° C. of about 40 centipoise and is delivered as a liquid of a solids content of about 100%. Another commercially available hydrophilic silicone surfactant that may be used as a wetting agent is DC193, INCI Name: PEG-12 Dimethicone, also marketed by Dow Corning Corporation. This material is a silicone glycol copolymer that is water soluble but insoluble in dimethicone and other hydrophobic polysiloxanes.

In another embodiment, acetylenic diols and derivatives can be used. For example, one commercially available acetylenic diol is SURFYNOL 104 PG-50 sold by Air Products, Inc., Allentown, Pa.

The manner in which the wetting agent is applied to a base web in accordance with the present invention is generally not critical. For instance, the wetting agent can be applied using a rotogravure printer, an inkjet printer, a flexographic printer, a spraying device, and the like. The wetting agent may also be applied to a drum dryer, such as a Yankee Dryer, where it is subsequently transferred to the basesheet. Relatively low levels of wetting agent are generally required to give acceptable performance. Exact levels required will depend upon the application and the desired degree of hydrophilicity. Specifically the amount of surfactant relative to the total weight of fibers can range from about 0.001% to about 2%, still more specifically from about 0.002% to about 1.5% and still more specifically from about 0.003% to about 1% by weight of dry fibers.

The wetting agent can be applied to one side of the base web or to opposing sides of the base web. Further, the wetting agent can be applied according to any suitable pattern. For most applications, the wetting agent covers less than about 50 percent of the surface area of one side of the base web, and particularly covers less than about 20 percent of the surface area of one side of the base web.

The pattern by which the wetting agent is applied to the base web can vary depending upon the particular application. For example, in some applications, the pattern can be somewhat random, such as when spraying the wetting agent onto the base web. In other embodiments, however, the pattern can be more defined and predetermined, such as when printing a wetting agent onto the base web. When treating opposite sides of the base web, the pattern can be the same or different.

Figure 2:
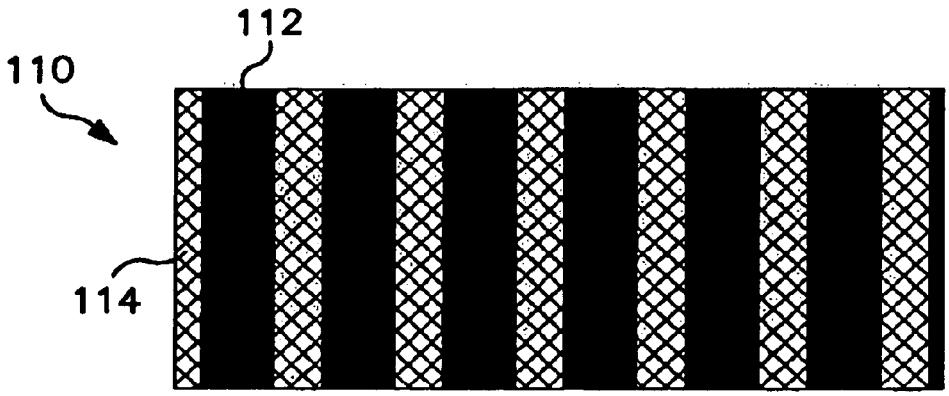
FIG. 2 is a plan view of another embodiment of a tissue product made in accordance with the present invention.
Figure 3:
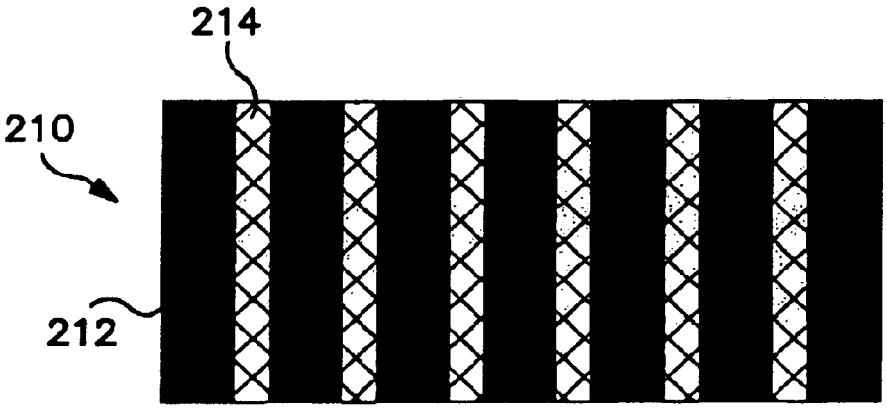
FIG. 3 is a plan view of still another embodiment of a tissue product made in accordance with the present invention.

For exemplary purposes only, FIGS. 1–3 show various embodiments of patterns that may be used in applying the wetting agents of the present invention. For example, referring to FIG. 1, one embodiment of one side of a base sheet 10 treated in accordance with the present invention is shown. Base sheet 10 can be formed into any suitable wiping product, such as a paper towel, a wiper, a bath tissue, a facial tissue, and the like. The base sheet 10 can have a single ply or can have a plurality of plies.

In accordance with the present invention, the base sheet 10 has been treated with a wetting agent. As shown, the base sheet 10 includes treated areas 12 where the wetting agent has been applied and untreated areas 14. In particular, FIG. 1 shows treated areas 12 and untreated areas 14 forming alternating columns on the base sheet 10. In this manner, the treated columns 12 form liquid absorbent channels that allow liquids to be easily absorbed into the middle of the base sheet.

As described above, the wetting agent of the present invention can be applied to a single side of the base sheet 10 or can be applied to both sides of the base sheet.

Referring to FIG. 2, another embodiment of a base sheet 110 treated with a wetting agent in accordance with the present invention is shown. As illustrated, the base sheet 110 includes treated areas 112 and untreated areas 114. In this embodiment, the columns containing the untreated areas 114 further include a pattern of the wetting agent. In particular, the wetting agent is applied as a grid to each of the columns in which the untreated areas appear.

Similarly, FIG. 3 also shows a base sheet 210 including columns of treated areas 212 and columns of untreated areas 214 that further include a grid where further amounts of the wetting agent have been applied.

It should be understood that FIGS. 1–3 merely represent some embodiments of the present invention. Almost a limitless variety of patterns can be applied to base sheets in accordance with the present invention. For example, in one embodiment, the wetting agent can be applied solely as a grid or other reticular pattern to one or more sides of the base sheet.

Figure 4:
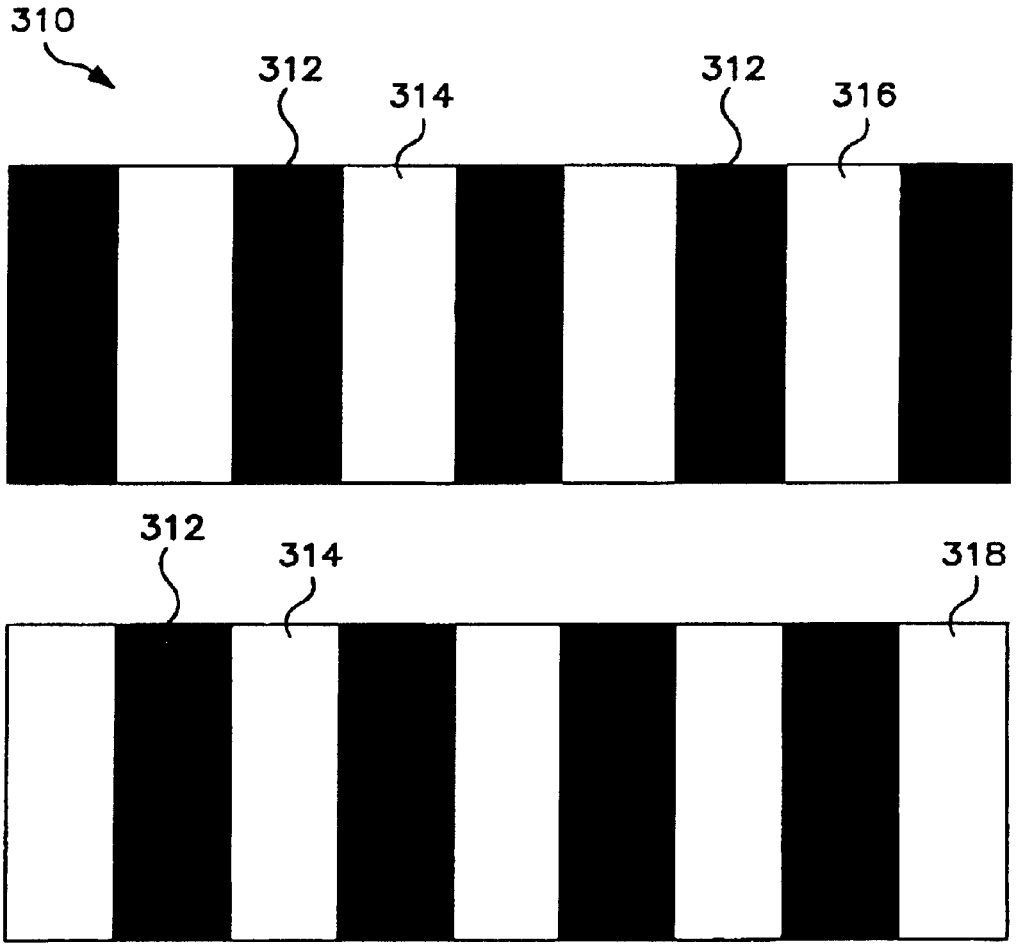
FIG. 4 is a plan view of still another embodiment of a tissue product made in accordance with the present invention.

Referring to FIG. 4, another embodiment of a base sheet 310 treated with a wetting agent in accordance with the present invention is shown. In this embodiment, the wetting agent has been applied to a first side of the base sheet 316 and to a second and opposite side of the base sheet 318. The base sheet 310 includes treated areas 312 and untreated areas 314. In this embodiment, similar to FIG. 1, the treated areas 312 and the untreated areas 314 form alternating columns on the base sheet.

In this embodiment, however, the treated columns 312 are in an offset relationship from the first side of the sheet to the second side of the sheet. Specifically, the treated areas on one side of the sheet are in alignment with untreated areas on the opposite side of the sheet and visa versa. In this manner, liquids can be quickly absorbed by the base sheet and yet remain retained within the base sheet. In particular, the treated areas on each side of the base sheet prevent liquids from flowing through the base sheet.

It should be understood that in any of the embodiments shown in FIG. 1, 2 or 3, the wetting agent can also be applied to both sides of the base sheet in an offset relationship.

In another embodiment, discrete aesthetic designs can be applied to the base sheet in accordance with the present invention. For example, the designs can be flowers, logos, or any other suitable figure. In order to make the patterns of the wetting agent visible to the user in the dry state, the wetting agent can be combined with a dye or other similar color-indicating agent. If no dye is present in the treated areas the patterns will be non-detectable in the dry state but will be detected when the tissue is wetted.

The wetting agent of the present invention can be applied to the base sheet at various points in the process of creating the tissue product. For instance, the wetting agent can be applied after the base sheet has been formed but prior to drying the base sheet wherein the web has a consistency of from about 10% to about 80%. Alternatively, the wetting agent can be applied after the base sheet is dried. In one embodiment, the wetting agent can be applied in a converting process during packaging of the tissue product.

According to the present invention, however, the wetting agent is not applied together with the hydrophobic additive. Further, for most applications, the base sheet is treated with the wetting agent after the hydrophobic additive has been applied to the product. It is believed that adding the wetting agent to the base sheet at a different time than the hydrophobic additive can provide various benefits. For example, if the hydrophobic additive were combined with the wetting agent and applied to a base sheet, the hydrophobic additive may be carried into the interior of the base sheet instead of remaining on the surface providing less benefit to the user.

As described above, paper products made in accordance with the present invention exhibit a beneficial combination of properties. In particular, not only do the products enjoy the benefits of the additives that are applied to the sheets, but the products also maintain acceptable wetability characteristics and strike through characteristics.

One test that measures the wetability of a paper product is referred to as the "Wet Out Time" test. The Wet Out Time of paper products treated in accordance with the present invention can be less than about 120 seconds and particularly less than about 60 seconds. For instance, in one embodiment, a tissue product treated in accordance with the present invention can have a wet out time of less than about 20 seconds.

As used herein, "Wet Out Time" is related to absorbency and is the time is takes for a given sample to completely wet out when placed in water. More specifically, the Wet Out Time is determined by cutting 20 sheets of the paper product into 2.5 inch squares. The number of sheets used in the test is independent of the number of plies per sheet of product. The 20 square sheets are stacked together and stapled at each corner to form a pad. The pad is held close to the surface of a constant temperature distilled water bath (23+/−2° C.), which is the appropriate size and depth to ensure the saturated specimen does not contact the bottom of the container and the top of the surface of the water at the same time. The pad is then dropped flat onto the water surface, staple points down. The time taken for the pad to become completely saturates, measured in seconds, is the Wet Out Time for the sample and represents the absorbent rate of the tissue. Increases in the Wet Out Time represent a decrease in the absorbent rate.

Any suitable paper product can be treated in accordance with the present invention. The paper product can be any suitable tissue product, such as a paper towel, a wiper, a bath tissue, a facial tissue or the like.

In one embodiment, paper webs treated in accordance with the present invention can have a stratified fiber furnish. For example, in one embodiment, the paper web can have a middle layer of softwood fibers positioned in between outer layers of hardwood fibers. If desired, each of the layers can also contain paper broke. In one particular embodiment, a stratified fiber furnish includes an outer layer of hardwood fibers, a middle layer of softwood fibers and paper broke, and a second outer layer of a mixture of hardwood fibers and softwood fibers.

In still another embodiment of the present invention, the stratified fiber furnish can include two outer layers of a mixture of hardwood fibers and paper broke. The fiber furnish can further include a middle layer of softwood fibers positioned in between the outside layers.

The basis weight of paper products treated in accordance with the present invention can also vary depending upon the ultimate use for the product. In general, the basis weight can range from about 6 gsm to 200 gsm and greater. For example, in one embodiment, the paper product can have a basis weight of from about 6 gsm to about 80 gsm.

In still another embodiment of the present invention, the finished tissue product is a 3-ply product. The two outer plies of the product comprise the hydrophobic additive and the wetting agent. In a specific embodiment the wetting agent is applied in a discrete pattern to the surface of either one or both of the outer plies such that less than 50% of the surface of the outer plies has been treated with the wetting agent. The interior ply of the three ply product contains a tissue or other such absorbent sheet not containing the hydrophobic additive. In a specific embodiment the wetting agent treated regions on one of the exterior plies are directly offset from regions untreated with the wetting agent on the opposite exterior ply.

Optional Chemical Additives

Optional chemical additives may also be added to the aqueous papermaking furnish or to the embryonic tissue sheet to impart additional benefits to the product and process and are not antagonistic to the intended benefits of the present invention. The following materials are included as examples of additional chemicals that may be applied to the tissue sheet with the cationic synthetic co-polymers and cationic synthetic co-polymer additives of the present invention. The chemicals are included as examples and are not intended to limit the scope of the present invention. Such chemicals may be added at any point in the papermaking process, such as before or after addition of the hydrophobic additive. They may also be added simultaneously with the hydrophobic additive or with the wetting agent. They may be blended with the hydrophobic additives or the wetting agents of the present invention or as separate additives.

Charge Control Agents

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Strength Agents

Wet and dry strength agents may also be applied to the tissue sheet. As used herein, "wet strength agents" refer to materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

Any material that when added to a tissue sheet or sheet results in providing the tissue sheet with a mean wet geometric tensile strength:dry geometric tensile strength ratio in excess of about 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50% of its original wet strength after exposure to water for a period of at least five minutes. Temporary wet strength agents are those which show about 50% or less than, of their original wet strength after being saturated with water for five minutes. Both classes of wet strength agents find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will typically provide a more or less long-term wet resilience to the structure of a tissue sheet. In contrast, the temporary wet strength agents will typically provide tissue sheet structures that had low density and high resilience, but would not provide a structure that had long-term resistance to exposure to water or body fluids.

Wet and Temporary Wet Strength Agents

The temporary wet strength agents may be cationic, nonionic or anionic. Such compounds include PAREZ™ 631 NC and PAREZ® 725 temporary wet strength resins that are cationic glyoxylated polyacrylamide available from Cytec Industries (West Paterson, N.J.). This and similar resins are described in U.S. Pat. No. 3,556,932, issued on Jan. 19, 1971 to Coscia et al. and U.S. Pat. No. 3,556,933, issued on Jan. 19, 1971 to Williams et al. Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as Cobond® 1000 from National Starch and Chemcial Company and other aldehyde containing polymers such as those described in U.S. Pat. No. 6,224,714 issued on May 1, 2001 to Schroeder et al.; U.S. Pat. No. 6,274,667 issued on Aug. 14, 2001 to Shannon et al.; U.S. Pat. No. 6,287,418 issued on Sep. 11, 2001 to Schroeder et al.; and, U.S. Pat. No. 6,365,667 issued on Apr. 2, 2002 to Shannon et al., the disclosures of which are herein incorporated by reference to the extend they are non-contradictory herewith.

Permanent wet strength agents comprising cationic oligomeric or polymeric resins can be used in the present invention. Polyamide-polyamine-epichlorohydrin type resins such as KYMENE 557H sold by Hercules, Inc., located at Wilmington, Del., are the most widely used permanent wet-strength agents and are suitable for use in the present invention. Such materials have been described in the following U.S. Pat. No. 3,700,623 issued on Oct. 24, 1972 to Keim; U.S. Pat. No. 3,772,076 issued on Nov. 13, 1973 to Keim; U.S. Pat. No. 3,855,158 issued on Dec. 17, 1974 to Petrovich et al.; U.S. Pat. No. 3,899,388 issued on Aug. 12, 1975 to Petrovich et al.; U.S. Pat. No. 4,129,528 issued on Dec. 12, 1978 to Petrovich et al.; U.S. Pat. No. 4,147,586 issued on Apr. 3, 1979 to Petrovich et al.; and, U.S. Pat. No. 4,222,921 issued on Sep. 16, 1980 to van Eenam. Other cationic resins include polyethylenimine resins and aminoplast resins obtained by reaction of formaldehyde with melamine or urea. It is often advantageous to use both permanent and temporary wet strength resins in the manufacture of tissue products with such use being recognized as falling within the scope of the present invention.

Dry Strength Agents

Dry strength agents may also be applied to the tissue sheet without affecting the performance of the disclosed cationic synthetic co-polymers of the present invention. Such materials used as dry strength agents are well known in the art and include but are not limited to modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. It may at times, however, be beneficial to blend the dry strength agent with the cationic synthetic co-polymers of the present invention and apply the two chemicals simultaneously to the tissue sheet.

Additional Softening Agents

At times it may be advantageous to add additional debonders or softening chemistries to a tissue sheet. Examples of such debonders and softening chemistries are broadly taught in the art. Exemplary compounds include the simple quaternary ammonium salts having the general formula $(R^{1'})_{4-b}N^{+}(R^{1''})_{b}X^{-}$ wherein R1' is a C1–6 alkyl group, R1" is a C14–C22 alkyl group, b is an integer from 1 to 3 and X— is any suitable counterion. Other similar compounds include the monoester, diester, monoamide and diamide derivatives of the simple quaternary ammonium salts. A number of variations on these quaternary ammonium compounds are known and should be considered to fall within the scope of the present invention. Additional softening compositions include cationic oleyl imidazoline materials such as methyl-1-oleyl amidoethyl-2-oleyl imidazolinium methylsulfate commercially available as Mackernium DC-183 from McIntyre Ltd., located in University Park, III and Prosoft TQ-1003 available from Hercules, Inc.

Miscellaneous Agents

In general, the present invention may be used in conjunction with any known materials and chemicals that are not antagonistic to its intended use. Examples of such materials and chemicals include, but are not limited to, odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, absorbency aids and the like. A wide variety of other materials and chemicals known in the art of papermaking and tissue production may be included in the tissue sheets of the present invention including lotions and other materials providing skin health benefits including but not limited to such things as aloe extract and tocopherols such as Vitamin E and the like.

The application point for such materials and chemicals is not particularly relevant to the present invention and such materials and chemicals may be applied at any point in the tissue manufacturing process. This includes pre-treatment of pulp, co-application in the wet end of the process, post treatment after drying but on the tissue machine and topical post treatment.

The present invention may be better understood with reference to the following examples.

EXAMPLE 1

A tissue sheet was manufactured according to the following procedure. About 60 pounds of polysiloxane pretreated eucalyptus hardwood kraft pulp fibers, comprising about 1.5% of a hydrophobic amino functional polysiloxane, were dispersed in a pulper for 30 minutes, forming a eucalyptus hardwood kraft pulp fiber slurry having a consistency of about 3%. The Eucalyptus hardwood pulp fiber slurry was then transferred to a machine chest and diluted to a consistency of about 0.75%.

About 60 pounds, air dry basis weight, of LL-19 northern softwood kraft pulp fibers were dispersed in a pulper for 30 minutes, forming a northern softwood kraft pulp fiber slurry having a consistency of about 3%. A low level of refining was applied for 6 minutes to the northern softwood kraft pulp fibers. After dispersing, the northern softwood kraft pulp fibers to form the slurry, the northern softwood kraft pulp fibers were passed to a machine chest and diluted to a consistency of about 0.75%. 1.8 pounds per ton of a commercially available glyoxylated PAM, Parez 631NC, was added to the northern softwood kraft pulp fibers in the machine chest and allowed to mix for 5 minutes prior to forwarding to the headbox.

Kymene 6500, a commercially available PAE wet strength resin from Hercules, Inc., was added to both the eucalyptus hardwood kraft pulp fiber and the northern softwood kraft pulp fiber slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 65% Eucalyptus hardwood kraft pulp fibers in the dryer side layer and about 35% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15% to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared comprising about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of approximately 0.25 g solids/$m^2$ of product. The finished layered tissue sheet was then converted into a 2-ply c-folded tissue product with the dryer side layer of each ply facing outward. The tissue product was analyzed for wet out times. The total % polysiloxane in the sample of the tissue product is about 1.0% by weight of total pulp fiber. The tissue product had a wet out time of greater than about 300 seconds and a Hercules Size Test (HST) value of greater than about 300 seconds, indicating a high level of hydrophobicity in the tissue sheet and the tissue product. A drop of water was dripped onto a sample of the tissue sheet. After one hour, it was observed that the tissue sheet had still not absorbed the drop of water.

Next, SURFYNOL 104 PG-50, an acetylenic diol, obtained from Air Products, Inc., Allentown, Pa. was applied as a coarse spray via a manual spray system at a rate of about 1 pound dry solids per hundred weight of oven dried fiber. After being applied to the tissue sheet, the sheet was dried in an oven at 105° C. for 2 minutes. A drop of water was then placed on the sheet and was absorbed by the sheet within about 100 seconds.

EXAMPLE 2

Example No. 1 was repeated except Dow Corning Q2-5211 polysiloxane polyether was used as the wetting agent. A drop of water was placed on the sheet and absorbed by the tissue sheet in less than two seconds.

EXAMPLE 3

Example 2 was repeated again using Dow Corning Q2-5211. In this example the wetting agent was applied to the tissue sheet as a fine mist using an air brush. The uniformity of the wetting agent in this example is much greater than the uniformity achieved with the coarser spray of examples 2 and 3. A drop of water was then placed on the sheet and was immediately absorbed. This example shows the ability to tailor absorbent properties.

EXAMPLE 4

The hydrophobic base sheet was converted to create a two-ply tissue product. The layers containing the treated fibers comprised the outside surfaces of the two-ply tissue product.

A 0.200 mL drop of water was placed on the base sheet. It took longer than 10 minutes for the base sheet to absorb the drop of water.

The two ply base sheet was then treated with Dow Corning DC193. The wetting agent was applied as a 1% aqueous solution via a gravure print process. The add-on rate of the wetting agent in the final sheet was about 0.05 pounds dry solids per 100 pounds of dry fiber. In the treated tissue a 0.200 ml drop of water took about less than 25 seconds to be completely absorbed.

EXAMPLE 5

Example 5 demonstrates a 3-ply embodiment of the present invention wherein the two exterior plies comprise a hydrophobic agent and the wetting agent and the interior ply comprises an absorbent tissue sheet not comprising a hydrophobic agent. Such sheets demonstrate exceptional absorbency with improved strikethrough characteristics. A three ply tissue product was made, the two exterior plies comprising the hydrophobic basesheet of example 1. The center ply of the three ply basesheet was composed of an uncreped through air dried tissue sheet having a basis weight of about 38 g/$m^2$ and a roll bulk of about 16 $cm^3$/g. Prior to treatment with the wetting solution it took greater than three minutes to absorb a 0.200 ml drop of water The three ply product was then treated with the wetting agent in general accordance with example 4. After treatment with the wetting agent the base sheet absorbed the water in six seconds.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A tissue product comprising:

a base sheet comprising pulp fibers, the base sheet including a first side and a second and opposite side, the base sheet having been uniformly treated with a hydrophobic additive;

a wetting agent applied to at least one side of the base sheet, the wetting agent having been applied to at least one side of the base sheet in a manner that includes treated areas and untreated areas to provide a tissue sheet having discrete hydrophobic and hydrophilic regions.

2. A tissue product as defined in claim 1, wherein the base sheet has a bulk of at least 2 cc/g.

3. A tissue product as defined in claim 1, wherein the base sheet is one ply.

4. A tissue product as defined in claim 1, wherein the base sheet comprises multiple plies.

5. A tissue product as defined in claim 1, wherein the wetting agent has an HLB of from about 7 to about 20.

6. A tissue product as defined in claim 1, wherein the wetting agent comprises a polyhydroxy compound, a non-ionic surfactant, a linear alkoxylated alcohol, a linear alkylphenoxylated alcohol, an olefinic alkoxylate, or a branched chain alkoxylate.

7. A tissue product as defined in claim 1, wherein the wetting agent covers less than about 50 percent of the surface area of at least one side of the base sheet.

8. A tissue product as defined in claim 1, wherein the wetting agent covers less than about 20 percent of the surface area of at least one side of the base sheet.

9. A tissue product as defined in claim 1, wherein the wetting agent is applied to both sides of the base sheet.

10. A tissue product as defined in claim 1, wherein the tissue product has a wet out time of less than about 60 seconds.

11. A tissue product as defined in claim 1, wherein the hydrophobic additive comprises a polysiloxane, the polysiloxane having been applied to the pulp fibers prior to formation of the base sheet.

12. A tissue product as defined in claim 1, wherein the hydrophobic additive is applied to the tissue product as fibers pretreated with the hydrophobic additive.

13. A tissue product as defined in claim 12, wherein the hydrophobic additive comprises a polysiloxane.

14. A tissue product as defined in claim 12, wherein the hydrophobic additive comprises an amino functional polysiloxane.

15. A tissue product as defined in claim 1, wherein the hydrophobic additive comprises an amino functional polysiloxane.

16. A tissue product as defined in claim 1, wherein the hydrophobic additive comprises a polysiloxane and wherein the polysiloxane has been topically applied to the base sheet.

17. A tissue product as defined in claim 16, wherein the polysiloxane has been applied to at least one side of the base sheet in an amount so as to cover at least 60 percent of the surface area of at least one side.

18. A tissue product as defined in claim 1, wherein the hydrophobic additive comprises a polysiloxane and wherein the total amount of polysiloxane in the tissue product is from about 0.03 to about 4 percent by weight of total dry fibers.

19. A tissue product as defined in claim 1, wherein the wetting agent comprises a silicone polyether, an ethoxylated polysiloxane, or a silicone copolyol.

20. A tissue product as defined in claim 1, wherein the tissue product comprises a facial tissue.

21. A tissue product as defined in claim 1, wherein the treated areas and untreated areas form alternating columns on each side of the base sheet.

22. A tissue product as defined in claim 1, wherein the tissue product has a basis weight of from about 6 gsm to about 150 gsm.

23. A process for producing tissue products comprising:

providing a base sheet comprising pulp fibers, the base sheet having a bulk density of at least 2 cc/g, the base sheet including a first side and a second and opposite side, the base sheet being uniformly treated with a hydrophobic additive;

applying a wetting agent to at least one side of the base sheet, the wetting agent being applied to at least one side of the base sheet in a manner that includes treated areas and untreated areas.

24. A process as defined in claim 23, wherein the untreated basesheet containing the hydrophobic additive has a wet out time of greater than about 120 seconds.

25. A process as defined in claim 23, wherein the wetting agent has an HLB of from about 7 to about 20.

26. A process as defined in claim 23, wherein the wetting agent comprises a polyhydroxy compound, a non-ionic surfactant, a linear alkoxylated alcohol, a linear alkylphenoxylated alcohol, an olefinic alkoxylate, or a branched chain alkoxylate.

27. A process as defined in claim 23, wherein the wetting agent comprises a silicone polyether, an ethoxylated polysiloxane, or a silicone copolyol.

28. A process as defined in claim 23, wherein the wetting agent is printed onto the base sheet.

29. A process as defined in claim 23, wherein the wetting agent is sprayed onto the base sheet.

30. A process as defined in claim 23, wherein the hydrophobic additive comprises a polysiloxane.

31. A process as defined in claim 30, wherein the polysiloxane comprises an amino functional polysiloxane.

32. A process as defined in claim 30, further comprising the step of forming the base sheet from pulp fibers pretreated with the polysiloxane.

33. A process as defined in claim 30, further comprising the step of topically applying the polysiloxane to the base sheet.

34. A process as defined in claim 23, wherein the wetting agent is applied to at least one side of the base sheet so as to cover less than about 50 percent of the surface area of at least one side.

35. A process as defined in claim 23, wherein the wetting agent is applied to both sides of the base sheet.

36. A process as defined in claim 23, wherein the tissue product treated with the wetting agent has a wet out time of less than about 60 seconds.

37. A process as defined in claim 23, wherein the tissue product treated with the wetting agent has a wet out time of less than about 30 seconds.

38. A process as defined in claim 23, wherein the wetting agent is applied in a pattern that comprises discrete shapes.

39. A process as defined in claim 23, wherein the tissue product has discrete hydrophobic and hydrophilic regions.

40. A process as defined in claim 23, wherein the wetting agent is applied to the base sheet in alternating columns.

41. A tissue product comprising:

a base sheet comprising pulp fibers, the base sheet having a bulk density of at least 2 cc/g, the base sheet having been uniformly treated with a hydrophobic additive, the hydrophobic additive comprising a polysiloxane, the base sheet including a first side and a second and opposite side; and a wetting agent applied to both sides of the base sheet, the wetting agent having been applied to both sides of the base sheet in a manner that includes treated areas and untreated areas to provide a tissue sheet having discrete hydrophobic and hydrophilic regions.

42. A tissue product of claim 41 wherein the untreated basesheet comprising the hydrophobic additive has a wet out time of about 120 seconds or greater.

43. A tissue product of claim 41 wherein the total amount of polysiloxane in the sheet is from about 0.03% to about 4% by weight of the total dry fiber weight.

44. A tissue product of claim 41 wherein the polysiloxane is an amino functional polysiloxane.

45. A tissue product of claim 41 wherein the polysiloxane is applied to the tissue product as pretreated fibers.

46. A tissue product of claim 41 wherein the tissue product is comprised of one ply.

47. A tissue product of claim 41 wherein the tissue product is a multi-ply tissue product.

48. A tissue product as defined in claim 41, wherein the wetting agent has an HLB of from about 7 to about 20.

49. A tissue product as defined in claim 41, wherein the wetting agent comprises a polyhydroxy compound, a non-ionic surfactant, a linear alkoxylated alcohol, a linear alkylphenoxylated alcohol, an olefinic alkoxylate, or a branched chain alkoxylate.

50. A tissue product as defined in claim 41, wherein the wetting agent is applied to each side of the base sheet in a manner that covers less than about 50 percent of the surface area of each side of the base sheet.

51. A tissue product as defined in claim 41, wherein the tissue product has a wet out time of less than about 60 seconds.

52. A tissue product as defined in claim 41, wherein the wetting agent comprises a silicone polyether, an ethoxylated polysiloxane, or a silicone copolyol.

53. A tissue product as defined in claim 41, wherein the tissue product comprises a facial tissue.

54. A tissue product as defined in claim 41, wherein the treated areas and untreated areas form alternating columns on each side of the base sheet.

55. A tissue product as defined in claim 41, wherein the tissue product comprises a paper towel.

* * * * *